United States Patent [19]

Emond et al.

[11] 3,953,226

[45] Apr. 27, 1976

[54] TANK CLEANING APPARATUS

[75] Inventors: Joseph Maurice Emond, Longeuil; James Dawson Haigh, St. Lambert, both of Canada

[73] Assignee: The Molson Companies Limited, Rexdale, Canada

[22] Filed: Oct. 16, 1974

[21] Appl. No.: 515,418

[30] Foreign Application Priority Data

July 24, 1974 Canada ..... 205547

[52] U.S. Cl. ..... 134/104; 134/168 R; 134/181

[51] Int. Cl.[2] ..... B08B 3/02; B08B 9/12

[58] Field of Search ..... 134/104, 167 R, 168 R, 134/180, 181, 166 R, 169 R, 171, 175, 177, 138–139

[56] References Cited

UNITED STATES PATENTS

| | | | |
|---|---|---|---|
| 2,081,339 | 5/1937 | Rue et al. | 134/168 R X |
| 3,121,027 | 2/1964 | Galanor | 134/168 R X |
| 3,454,018 | 7/1969 | Ruddick | 134/166 R X |
| 3,645,452 | 2/1972 | Stoeckel et al. | 134/168 R X |
| 3,837,011 | 9/1974 | McTighe et al. | 134/167 R X |
| R27,612 | 4/1973 | Ruppel et al. | 134/168 R X |

FOREIGN PATENTS OR APPLICATIONS

| | | | |
|---|---|---|---|
| 738,220 | 7/1966 | Canada | 134/180 |
| 26,377 | 1/1954 | Finland | 134/168 |

*Primary Examiner*—Robert L. Bleutge
*Attorney, Agent, or Firm*—Anthony J. Casella

[57] ABSTRACT

The present invention relates to apparatus for scouring sludge from a hot wort tank employed in a brewing process with the apparatus including an oscillating hot water pipe located within the tank and provided with jets for sweeping the sludge into a sump, the apparatus also including a drive located on the outside of the tank for oscillating said pipe.

5 Claims, 2 Drawing Figures

TANK CLEANING APPARATUS

This invention relates to tank cleaning apparatus and, in particular, to apparatus for cleaning hot wort tanks used in the brewing art.

As is well known in the brewing art, settling tanks are employed for separating the wort sludge or protein participate from hot wort — such settling tanks being known as hot wort tanks or hot break tanks. The high costs of production make it imperative that as much wort as possible be removed from a hot wort tank without, of course, the inclusion of sludge in such liquid. Furthermore, it is most desirable, that when the sludge has been separated from the wort, to ensure that none of the sludge enters the public sewage system. This is desirable not only from the viewpoint of pollution and environmental control but also from that of economy because the wort sludge can, and is in fact often, employed in many byproducts such as cattle feedstuffs. Moreover, and because the sludge is employed in by-products, it is also desirable to remove as much liquid wort from the sludge prior to collection in a sludge tank. Thus, it is the object of the present invention to ensure that (a) as much wort as possible is removed from the tank; (b) that the tank is scoured clean of all sludge; (c) that no sludge enters the public sewage system; (d) that as much liquid wort as possible is removed from the sludge; and (e) that the least amount of water is used to remove the sludge.

Figure 1:
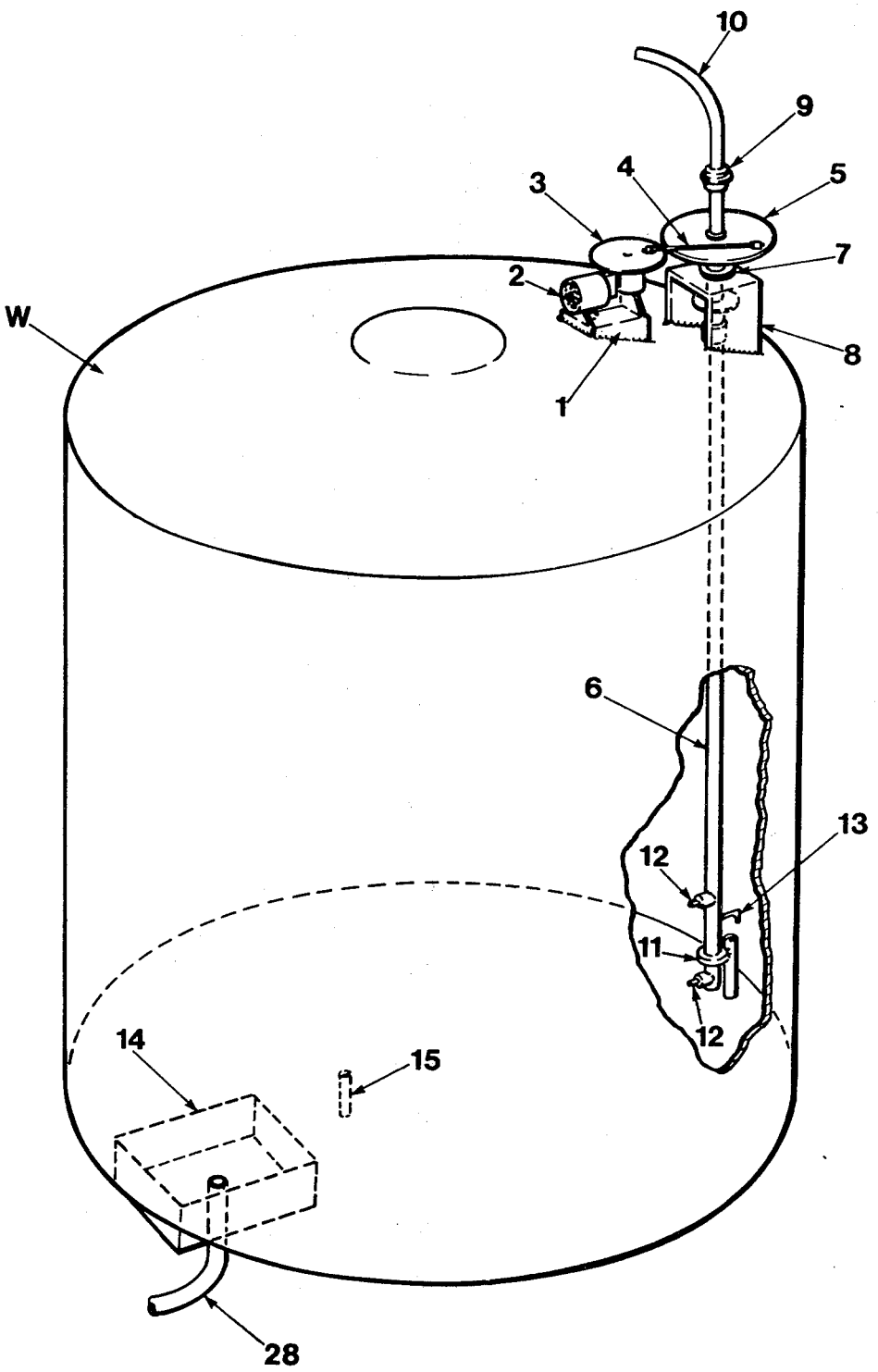
Figure 2:
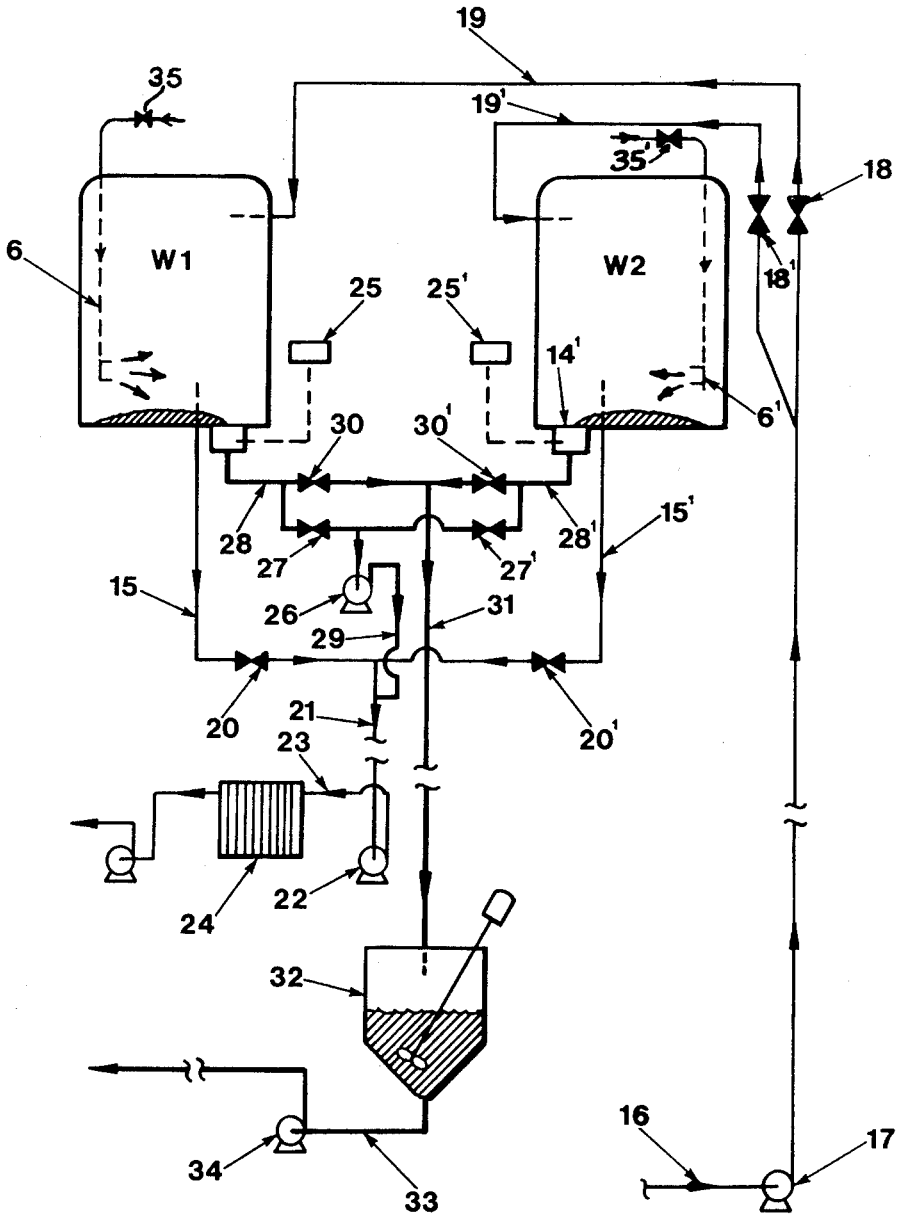

The invention is illustrated by way of example in the accompanying drawings in which:

FIG. 1 is a diagrammatic view of a hot wort tank including the sludge removal means; and FIG. 2 is a diagrammatic flow chart where a pair of such tanks operate in tandem with one another.

Referring to FIG. 1, the oscillating spray device for a hot wort tank W includes a bracket 1 fast on the top of the tank and which bracket serves as the mounting for a variable speed motor 2 actuated to rotate a vertically mounted circular plate 3 to which one end of a link 4 is fast. The other end of the link 4 is fast on another vertically mounted circular plate 5 which is fast on the upper and projecting end of a vertically depending water pipe 6 which extends into the tank W. The upper end of the pipe 6 is journalled in a collar 7 mounted on a bracket 8 fast on the top of the tank W. The upper terminal end of pipe 6 is connected, by means of a swivel-connection 9, to the end of a hot water pipe 10. As will be observed from FIG. 1, the lower end of pipe 6 is journalled in a collar 11 spaced from, but indirectly secured to, the bottom of the wort tank W and is provided with a pair of vertically spaced spray jets 12 and a further jet 13. The interior of the tank is also provided with a sump 14 and an outlet pipe 15.

In operation, a pair of tanks W1 and W2 in tandem with one another (see FIG. 2) are alternately filled with hot wort and then cooled. They are filled via a common feeder line 16 extending from a hop separator (not shown) through wort pump 17 and through individual valves 18,18' and branch lines 19,19'. Inasmuch as the branch entry lines 19,19' are tangentially arranged with respect to the central vertical axis of each tank, a swirling action or vortex is created which tends to migrate solids towards the centre of the tanks so that as the wort cools down over a period of 1 hour to 195°F, a precipitate or sludge will form on the bottom of each tank which precipitate is thicker towards the centre of each said bottom than towards the periphery thereof.

The sludge mainly consists of protein, with hop leaves, grain husks, etc. included.

When the hot wort is required to be removed from tank W1, a first valve 20 is opened which permits the wort to flow out of said tank through outlet pipe 15, line 21, pump 22, line 23 and an APV cooler 24 to storage tanks (not shown). When the level of the liquid reaches approximately 6 inches above the bottom of the tank, such level will be sensed by a liquid level sensing device 25 whereupon first value 20 will close and a companion valve 20' associated with tank W2 will open whereupon the draining process just described for tank W1 will be repeated for tank W2.

As will be appreciated, however, there is still 6 inches of liquid remaining in the bottom of tank W1 and this must also be removed so that as first valve 20 closes, a pump 26 is activated and a second valve 27 located in line 28, terminating at one end in sump 14, will open. This enables the last 6 inches of liquid to be pumped out, via lines 29 and 21 and through cooler 24, to the storage tanks leaving the sludge behind.

When tank W1 is finally empty, the second valve 27 closes and third and fourth valves 30 and 35 open. Simultaneously motor 2 (FIG. 1) is energized rotating plate 3 and actuating link 4 and plate 5 to oscillate pipe 6 through a sweep of approximately 140° – 145°. This causes jets 12 to scour the bottom of the tank with hot water driving the sludge into the sump 14 while jet 13 scours that portion of the tank located behind the jets 12 and not reached by the latter. The sludge then leaves the sump 14, via line 28, valve 30 and line 31 and eventually into a sludge tank 32. From the latter, and via line 33 and pump 34, the sludge is eventually mixed with spent grain when the mixture then becomes the basis for any one of a number of by-products. The cleaned tank is then ready for refilling.

Although the invention has been described above in connection with a pair of tanks in tandem, it will be perfectly obvious that the invention is equally applicable to a single tank working independently of any other or an additional number of tanks.

We claim:

1. Apparatus for scouring a hot wort tank from sludge, including a hot water pipe vertically mounted adjacent a side wall within said tank and depending from the top thereof and having its upper end projecting from said tank; jet means located on, and adjacent to, the lower end of said pipe; and means located on the outside of said tank for automatically oscillating said pipe about the vertical axis whereby, when desired, hot water issuing from said jets will scour the sludge into a sump located in the bottom of said tank, said oscillating means including a motor and a drive from the latter to a circular plate disposed about and fast with the upper end of said pipe, said drive including link means for oscillating said plate.

2. Apparatus according to claim 1 including a primary hot wort outlet line from said tank and a first valve in said line; a secondary outlet line from said sump connected to said primary line by a second valve and to a sludge exhaust line by a third valve.

3. Apparatus according to claim 2 wherein the second and third valves are maintained in closed condition and the first valve is opened to remove the major amount of hot wort from the tank via the primary line.

4. Apparatus according to claim 3 wherein when the liquid within the tank drops to a predetermined level, the first and third valves are maintained in closed condition and the second valve is opened to remove the remainder of the liquid from the tank via said secondary outlet line.

5. Apparatus according to claim 4 wherein when the tank has been substantially emptied of liquid, the first and second valves are maintained in closed condition and the third valve is opened simultaneously with actuation of said motor and oscillation of said pipe to scour the interior of the sump into said sludge exhaust line.

* * * * *